US009427806B2

(12) United States Patent
Prest et al.

(10) Patent No.: US 9,427,806 B2
(45) Date of Patent: Aug. 30, 2016

(54) METHOD AND APPARATUS FOR FORMING A GOLD METAL MATRIX COMPOSITE

(71) Applicant: Apple Inc., Cupertino, CA (US)

(72) Inventors: Christopher D. Prest, San Francisco, CA (US); Lucy E. Browning, San Francisco, CA (US); Michael K. Pilliod, Venice, CA (US); Theodore A. Waniuk, Lake Forest, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/296,025

(22) Filed: Jun. 4, 2014

(65) Prior Publication Data

US 2014/0361670 A1 Dec. 11, 2014

Related U.S. Application Data

(60) Provisional application No. 61/833,341, filed on Jun. 10, 2013.

(51) Int. Cl.

| | |
|---|---|
| ***B22F 3/12*** | (2006.01) |
| ***B22F 7/00*** | (2006.01) |
| ***B22F 1/02*** | (2006.01) |

(52) U.S. Cl.

CPC ..... *B22F 7/008* (2013.01); *B22F 1/02* (2013.01); *B22F 7/002* (2013.01); *Y10T 428/12153* (2015.01)

(58) Field of Classification Search

None

See application file for complete search history.

(56) References Cited

U.S. PATENT DOCUMENTS

| | | | | |
|---|---|---|---|---|
| 3,173,785 | A * | 3/1965 | Manganello | 419/10 |
| 3,901,717 | A * | 8/1975 | Revaz | 428/539.5 |
| 4,130,506 | A * | 12/1978 | Collier et al. | 252/1 |
| 4,274,877 | A * | 6/1981 | Collier et al. | 75/252 |
| 4,955,135 | A | 9/1990 | Pinkhasov | |
| 4,971,944 | A * | 11/1990 | Charles et al. | 505/470 |
| 5,045,972 | A * | 9/1991 | Supan et al. | 361/706 |
| 5,834,689 | A | 11/1998 | Cook | |

(Continued)

FOREIGN PATENT DOCUMENTS

| | | | |
|---|---|---|---|
| CN | 1544196 | A | 11/2004 |
| CN | 1940102 | A | 4/2007 |
| CN | 101070461 | A | 11/2007 |

OTHER PUBLICATIONS

PCT/US2014/040827. Int'l Search Report-Written Opinion. Sep. 29, 2014.

Chinese Office Action dated Feb. 29, 2016 of Chinese Patent Application No. 201410254210.3.

*Primary Examiner* — George Wyszomierski
*Assistant Examiner* — Ngoclan T Mai
(74) *Attorney, Agent, or Firm* — Downey Brand LLP

(57) ABSTRACT

A metal matrix composite using as one of the components a precious metal is described. In one embodiment, the precious metal takes the form of gold and the metal matrix composite has a gold mass fraction in accordance with 18 k. The metal matrix composite can be formed by blending a precious metal (e.g., gold) powder and a ceramic powder, forming a mixture that is then compressed within a die having a near net shape of the metal matrix composite. The compressed mixture in the die is then heated to sinter the precious metal and ceramic powder. Other techniques for forming the precious metal matrix composite using HIP, and a diamond powder are also disclosed.

15 Claims, 9 Drawing Sheets

(56) References Cited

U.S. PATENT DOCUMENTS 6,238,454 B1 * 5/2001 Polese et al. ..... 75/243
6,572,670 B1 * 6/2003 Theide et al. ..... 75/235
2002/0086165 A1 7/2002 Davis et al.
2002/0168538 A1 11/2002 Ellis
2011/0159216 A1 * 6/2011 Millar et al. ..... 428/34.1
2012/0164429 A1 6/2012 Shah et al.

* cited by examiner

METHOD AND APPARATUS FOR FORMING A GOLD METAL MATRIX COMPOSITE

CROSS-REFERENCE TO RELATED APPLICATIONS

This application claims priority to U.S. Provisional Application Ser. No. 61/833,341 filed Jun. 10, 2013 entitled "Method and Apparatus For Forming A Gold Metal Matrix Composite", which is incorporated herein by reference in its entirety.

FIELD

The described embodiments relate generally to methods for assembly of multi-part devices. In particular, methods for providing a metal matrix composite that is rugged, scratch resistant and presents an aesthetically pleasing appearance are described.

BACKGROUND

A metal matrix composite (MMC) is composite material with at least two constituent parts, one being a metal. The other material may be a different metal or a non-metal material, such as a ceramic. MMCs are made by dispersing a reinforcing material into a metal matrix. The matrix is the monolithic material into which the reinforcement is embedded. In structural applications, the matrix is usually a lighter metal such as aluminum, magnesium, or titanium, and provides a compliant support for a reinforcement material. The reinforcement material is embedded into the matrix. The reinforcement material does not always serve a purely structural task (i.e., reinforcing the MMC), but can also change physical properties such as a wear resistance, friction coefficient, or thermal conductivity of the MMC. The reinforcement material can be either continuous, or discontinuous. Discontinuous MMCs can be isotropic, and can be worked with standard metalworking techniques, such as extrusion, forging or rolling. In addition, they may be machined using conventional techniques, but commonly would need the use of polycrystalline diamond tooling (PCD).

What is desired is a metal matrix composite that presents a cosmetically appealing appearance that is maintained throughout an operating lifetime and is relatively inexpensive to manufacture in both processing and materials.

SUMMARY

This paper describes various embodiments that relate to assembly of cosmetically appealing devices. In particular embodiment, a precious metal matrix can be formed that provides an overlay for a device that is cosmetically appealing and is also rugged enough to maintain the cosmetically appealing appearance throughout an operating life of the device.

According to one embodiment, a gold metal matrix composite is formed. The gold metal matrix composite includes a porous preform that includes a number of ceramic particles and spaces positioned between the ceramic particles. The gold metal matrix composite also includes a gold matrix including a network of gold formed within the spaces of the porous preform. The gold metal matrix composite is characterized as 18 k gold.

According to another embodiment, a housing for an electronic device is described. The housing includes a precious metal matrix composite forming at least a portion of an external surface of the housing. The precious metal matrix includes a continuous metal material having at least one type of precious metal. The precious metal matrix also includes a number of ceramic particles dispersed within the continuous metal material. The ceramic particles increase a hardness of the precious metal matrix composite compared to the continuous metal material without the ceramic materials. The precious metal matrix composite includes about 75% precious metal by mass.

According to an additional embodiment, a method of forming a gold metal matrix composite is described. The method includes forming a gold and ceramic mixture by coating a number of ceramic particles with gold. The method also includes placing the gold and ceramic mixture into a die having a near net shape. The method additionally includes compressing and heating the gold and ceramic mixture in the die forming a gold metal matrix composite having a shape corresponding to the near net shape.

According to a further embodiment, a method of forming a gold and diamond matrix composite is described. The method includes forming a gold and diamond mixture using gold particles and diamond particles. The method also includes modifying or coating a surface of the diamond particles using a wetting agent. The modified or coated diamond surface is suitable for binding with the gold particles. The method further includes compressing and heating the gold and diamond mixture. The wetting agent forms a carbide at the diamond surface, the carbide suitable for binding with the gold during the compressing and heating.

It should be noted that for any of the methods described above, the ceramic can take many forms. For example, the metal matrix composite can include in addition to gold any of the following in any combination: boron carbide, diamond, cubic boron nitride, titanium nitride (TiN), iron aluminum silicate (garnet), silicon carbide, aluminum nitride, aluminum oxide, sapphire powder, yttrium oxide, zirconia and tungsten carbide. The choice of materials used with the gold in the metal matrix composite can be based upon many factors such as color, desired density (perceived as heft), an amount of gold required to meet design/marketing criteria, and so on.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The described embodiments may be better understood by reference to the following description and the accompanying drawings. Additionally, advantages of the described embodiments may be better understood by reference to the following description and accompanying drawings in which.

DETAILED DESCRIPTION

Figure 1A:
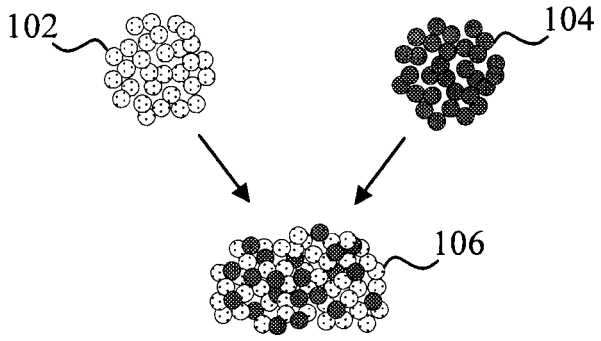
FIGS. 1A-1D show a powder metallurgy process for forming a gold metal matrix composite in accordance with described embodiments.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

This paper provides a description of methods and associated apparatuses for providing a metal matrix composite well suited for use as an external structure for a device. In some embodiments, the device is an electronic device or an accessory for an electronic device. In particular embodiments, the metal matrix composite forms a housing or a portion of a housing of an electronic device. In some embodiments, the metal matrix composite includes as at least one precious metal. The precious metal can include, for example, one or more of gold, silver and platinum. In this way, the metal matrix composite can provide a cosmetically appealing and rugged component that can be used to enhance the experience of a user of the device.

For the remainder of this discussion, the metal matrix composite includes gold (or predominantly gold) as the precious metal. However, other precious metals, such as silver and/or platinum, can also be used in accordance with described embodiments. In some embodiments, gold and one or more different metals, such as different precious metal, are used in conjunction within a metal matrix composite.

In general, an indication of an amount of gold in the metal matrix composite can be expresses in terms of karats (or carats), which represents the amount of gold in a gold alloy, where 24 k represents almost pure gold and 18 k represents $^{18}/_{24}$ or 75% gold by mass. More specifically, karat purity is measured as 24 times the purity by mass as:

$$k=24\times(M_g/M_m) \text{ where}$$

k is karat rating of the material, $M_g$ is the mass of pure gold in the material, and $M_m$ is the total mass of the material It should be noted that in general usage, due to the inherent softness of elemental gold, gold is generally alloyed to less than 24 k using a number of metals such as silver, platinum, etc. In the context of the following discussion, however, a gold metal matrix composite (gMMC) can include in addition to gold, alloying metals such as silver, and/or a ceramic material as reinforcement materials. The choice of ceramic can depend on material properties desired for the gMMC. Such material properties can include, for example, hardness, corrosion resistance, machinability and color. Color, in particular, can be selected based upon specific ceramic materials. For example, silicon carbide powder can be black or green whereas yttrium oxide powder can be white. In this way, a gMMC can be rendered to reflect light in specific ranges of the visible light spectrum to provide a desired color appearance.

In addition to using as little gold as possible while maintaining a specific karatage, a gMMC can be formed that has selected aesthetic properties well suited for providing a favorable user experience. For example, a unit volume of 18 k of gMMC that uses gold in combination with a ceramic as a reinforcement can be less dense, can require less gold, and can be more scratch resistant than that of a unit volume of gold alloy of the same karatage without ceramic. Scratch resistance is generally related to a hardness of the gMMC, which can be measured using a Vickers hardness test. In embodiments described herein, the hardness of gMMC is generally harder than gold alloy of the same karatage. In some embodiments, the gMMC has a hardness of at least 400 Hv, as measured by Vickers test.

Moreover, by selecting specific ceramic materials, a gMMC can be scratch and corrosion resistant, can be polished to a high degree to bring out a natural luster, can possess a high degree of machinability (i.e., can be easily machined into any desired shape), and in some cases, provide good heat transfer characteristics. For example, diamond powder can be used with gold to form a gMMC that has superior heat transfer characteristics due to the superior heat transfer characteristics of the diamond reinforcement. However, it should be noted, that in order for gold and diamond to form a viable gMMC, a wetting agent may be required that facilitates wetting a surface of the diamond by the gold. Boron, silicon, titanium, chromium and tungsten are examples of suitable wetting agents that can react with diamond to form a carbide layer that facilitates wetting the surface of the diamond by a matrix metal, which may be necessary for the formation of a gold and diamond MMC.

Other ceramic properties of interest can include a size of the ceramic particles. Particles that are too large may hinder polishing of the gMMC since large particles may be removed during a polishing operation and cause pitting of the gMMC surface. Moreover, a large sized particle also has the potential to hinder a sintering process in that large particles have a tendency to form large gaps between particles. The large gaps between particles can hinder the ability of the large particles to coalesce during the sintering operation. In addition, in some embodiments, the size of the ceramic particles are sufficiently small so as to give the gMMC a continuous appearance. That is, the ceramic particles are not so big as to be visibly distinguishable within the gMMC.

It should also be noted, that there can be an optimal range of ceramic volume fraction in accordance with a fixed karatage value. The optimal range of ceramic volume fraction can be based upon a desired hardness range of the gMMC. For example, if the ceramic volume fraction is reduced (relatively more gold), then the hardness of the gMMC can be reduced (approaching that of pure gold). As the volume fraction of ceramic increases (with a concomitant decrease in an amount of gold), the hardness of the gMMC generally increases to the point where the gMMC starts to exhibit brittleness. Therefore, an optimal range of ceramic volume fraction can be determined based on desired gMMC material properties, gMMC karatage, ceramic density and other properties.

For the remainder of this discussion, a metal matrix composite having gold as at least one metallic constituent and a ceramic as a reinforcement constituent is discussed. In particular, the gMMC is 75% by mass gold and 25% by mass ceramic reinforcement in accordance with an 18 k material. It should be noted, however, that methods described herein are not limited only gold and ceramic metal matrix composites and that any suitable matrix compositions in any suitable karatage can be used in accordance with described embodiments.

Since per unit volume, the density of ceramic particles is less than metals generally used to alloy gold (e.g., copper, silver, nickel), a unit volume of 18 k gMMC is less dense and thus requires less gold than a unit volume of gold alloy. Accordingly, the size (density) of the ceramic particles can be tuned to achieve a desired MMC density that can be expressed by the following:

$\rho_1$ is density of gold, $\rho_2$ is density of ceramic, $V_1$ is volume of 1 kg of gMMC, k is karatage $$V_1=(1-(k/24)/\rho_2)+((k/24)/\rho_1))$$

for k=18

$$V_1=(0.25/\rho_2)+(0.75/\rho_1)$$

$$VF_{ceramic}=((0.25/\rho_2)/V_1)$$

$$VF_{gold}=((0.75/\rho_1)/V_1)$$

Accordingly, as k increases (greater proportion of the gMMC is gold), the corresponding volume fraction of ceramic ($VF_{ceramic}$) decreases. However, for a constant k, as the density ($\rho_2$) of the ceramic increases, the corresponding ceramic volume fraction ($VF_{ceramic}$) decreases. Therefore, as the density of the reinforcement is decreased for a constant k, the mass of gold used for the same part decreases. Moreover, since the density of 18 k gMMC is less than a 18 k metal-based gold alloy, the amount of gold used in the 18 k gMMC is less than that used in a 18 k metal-based gold alloy.

FIGS. 1A-1D show a powder metallurgy process for forming a gMMC in accordance with described embodiments. At FIG. 1A, gold particles 102 and ceramic particles 104 are blended together forming mixture 106. Gold particles 102 can be in any suitable form, including in the form of a powder or flakes of gold. Gold particles 102 can be made of substantially pure gold or a gold alloy. Ceramic particles 104 can be made of any suitable type of ceramic materials, such as suitable metal oxides, carbides, borides, nitrides and silicides. In some embodiments, ceramic particles 104 include one or more of garnet, boron carbide, silicon carbide, aluminum nitride, diamond, boron nitride, aluminum oxide, sapphire, yttrium oxide, titanium oxide and zirconia. As described above, the type of ceramic material can be chosen based on factors such as a desired color, density, hardness, corrosion resistance, machinability and polish-ability of a final gMMC. Gold particles 102 and ceramic particles 104 can be blended using any suitable mixing technique. It should be noted that in order to assure good mixing and provide a good basis for subsequent sintering operation, the size of ceramic particles 104 can be selected to minimize an amount of open space between ceramic particles 104 in mixture 106. As described above, the relative amount of gold particles 102 within mixture 106 will depend upon a desired karatage of the final gMMC.

As described above, in some embodiments, a wetting agent is used to assist binding of ceramic particles 104 with gold particles 102 during a subsequent compressing operation and/or sintering operation. Ceramic particles 104 can be coated with the wetting agent prior to mixing with gold particles or the wetting agent can be added to mixture 106. In some embodiments, the wetting agent modifies the surfaces of ceramic particles 104. For example, diamond particles can be coated with a wetting agent that modifies the surfaces of the diamond particles by causing carbide to form on the surfaces of the diamond particles. The carbide assists binding of ceramic particles 104 to gold particles 102 during subsequent sintering. In some embodiments, the wetting agent includes one or more of boron, silicon, titanium, chromium and tungsten.

Figure 1B:
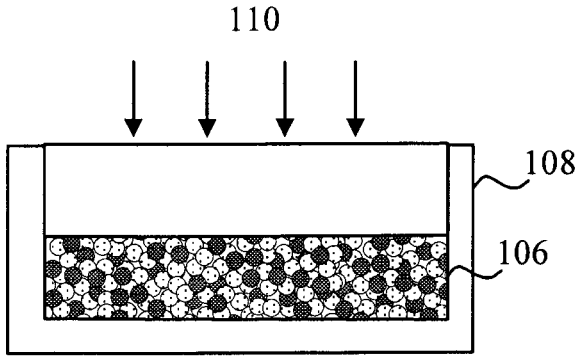

At FIG. 1B, mixture 106 is placed within die 108 having a near net shape that is similar to a final shape of the gMMC. While within die 108, pressure 110 is exerted onto mixture 106 such that the porosity of mixture 106 is reduced. That is, the density of mixture 106 is increased. The density of mixture 106 after compression is proportional to the amount of pressure 110 applied. In addition, mixture 106 is pressed against die 108 so as to take on the near net shape of die 108. In some embodiments, heat is applied to gMMC during the compression. After compression, compressed mixture 106 can be removed from die 108 and retain the near net shape.

Figure 1C:
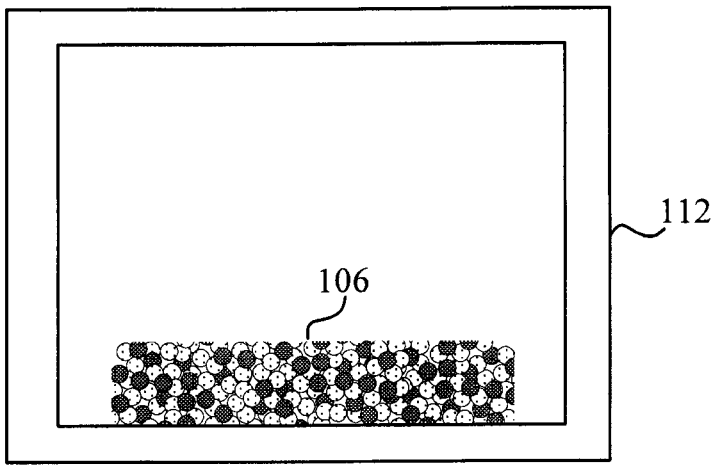

At FIG. 1C, compressed mixture 106 is placed into oven 112 and exposed to sintering operation. During sintering compressed mixture 106 is heated such that bonding occurs between gold particles 102 and ceramic particles 104 within compressed mixture 106. Note that in some embodiments, compressing process (FIG. 1B) and heating process (FIG. 1C) are combined within a single process, sometimes referred to as a Hot Isostatic Pressing (HIP) process. That is, mixture 106 is exposed to a pressure and to heat at the same time. This can be accomplished using a die that is designed to conduct heat to mixture 106 while compressing mixture 106. Once cooled, gMMC 114 is formed having the near net shape of die 108.

Figure 1D:
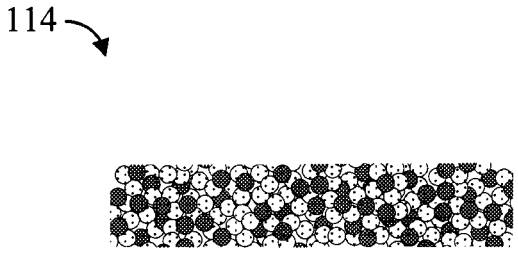

At FIG. 1D, gMMC 114 can then be removed from oven 112. In some embodiments, gMMC 114 is the exposed to one or more shaping processes, such as one or more machining or polishing processes, such that gMMC 114 takes on a final desired shape. In some embodiments, gMMC 114 takes on a final shape suitable for housing or a portion of a housing for an electronic device. In some embodiments, gMMC 114 forms an exterior portion of the housing, such as a layer that covers exterior surfaces of the housing. Since gMMC 114 includes a ceramic portion originating from ceramic particles 104, gMMC 114 has higher scratch resistance and hardness compared to a gold or gold alloy structure. The gold portions of gMMC 114 originating from gold particles 102 give gMMC 114 a gold color and appearance. As described above, the density of gMMC 114 of ceramic particles is less than metals generally used to alloy gold. Thus, a unit volume of gMMC 114 is generally less dense and thus requires less gold than a unit volume of a gold metal alloy.

Figure 2:
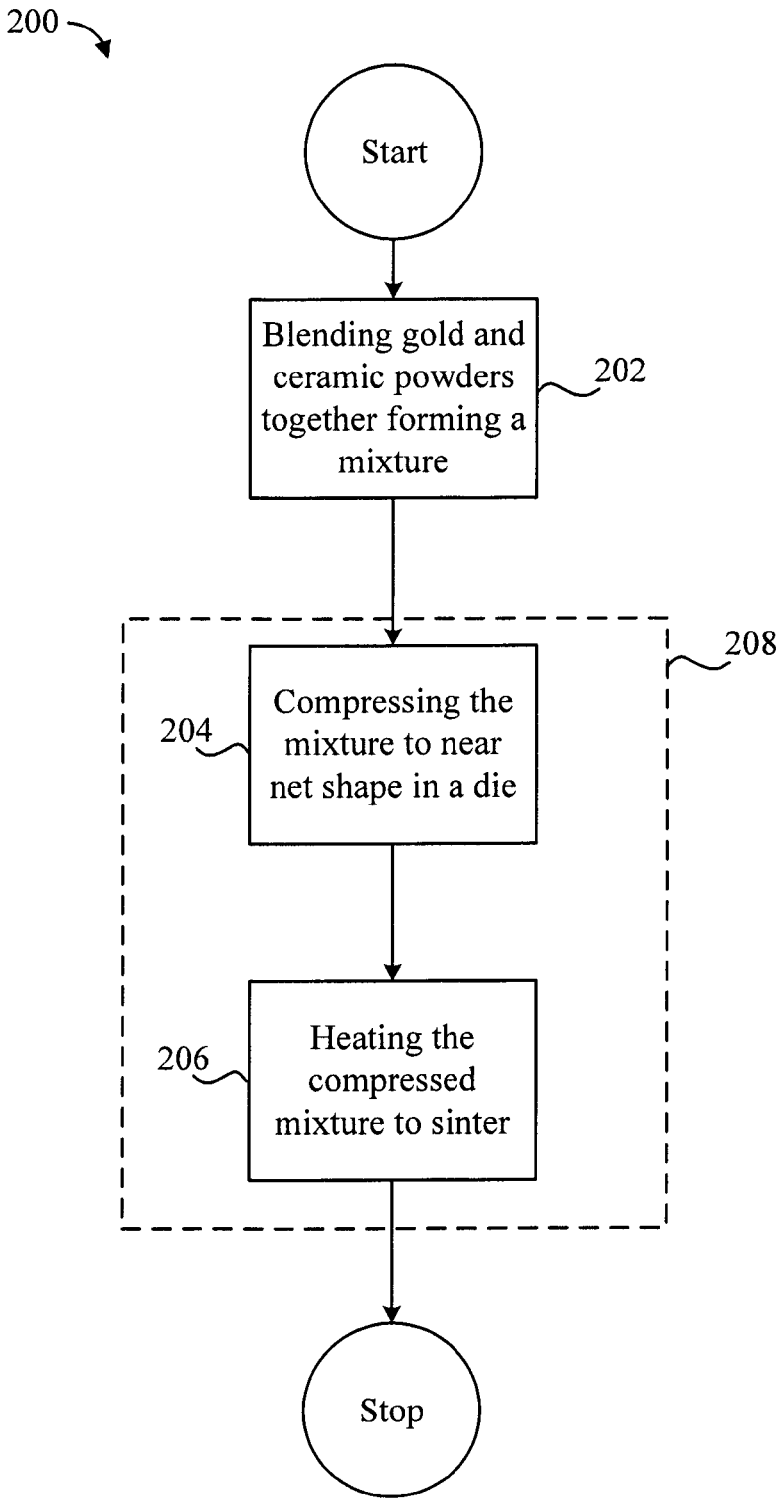
FIG. 2 shows a flowchart detailing the powder metallurgy process in accordance with FIGS. 1A-1D.

FIG. 2 is a flow chart detailing a powder metallurgy process 200 in accordance with the described embodiments. Process 200 can be carried out by performing at least the following operations. At 202, gold particles can be blended with a corresponding amount of ceramic particles forming a of gold and ceramic mixture. In some embodiments, the gold particles and ceramic particles are each in the form of a powder. At 204, the gold and ceramic mixture is formed into a near net shape, by which it is meant that the gold and ceramic mixture is processed in such a way as to take on a form similar to a desired final shape. In one embodiment, the forming into the near net shape can be carried out by compressing the mixture in a die or other container having a shaped interior. At 206, the compressed mixture can be heated in a sintering operation that causes the gold and ceramic particles to bond with each other. In some cases operations 204 and 206 can be combined into a single operation 208 using Hot Isostatic Pressing, or HIP.

FIGS. 3A-3E show a squeeze casting process for forming a gMMC in accordance with described embodiments. At FIG. 3A, ceramic particles 302 are combined with mixture 306, which includes binder 304 and water, within container 310 forming preform composite 308. Ceramic particles 302 can be in any suitable form, including in the form of a ceramic powder, and can be made of any suitable type of ceramic materials, such as suitable metal oxides, carbides, borides, nitrides and silicides. The type of ceramic material can be chosen based on factors such as a desired color, density, hardness, corrosion resistance, machinability and polish-ability of a final gMMC. Binder 304 can be made of any material suitable for binding ceramic particles 302 together when in aqueous solution and that is removable during a binder removal process. In some embodiments, binder 304 includes a commercially available ceramic binder.

Figure 3A:
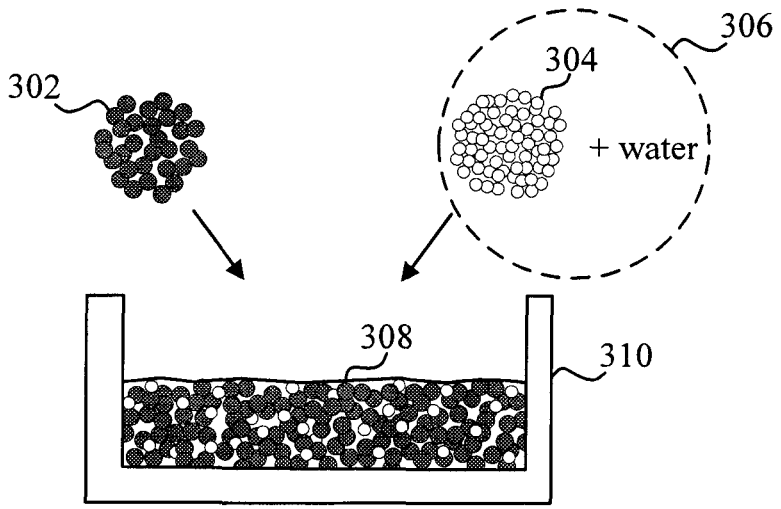
FIGS. 3A-3E show a squeeze casting process for forming a gold metal matrix composite in accordance with described embodiments.
Figure 3B:
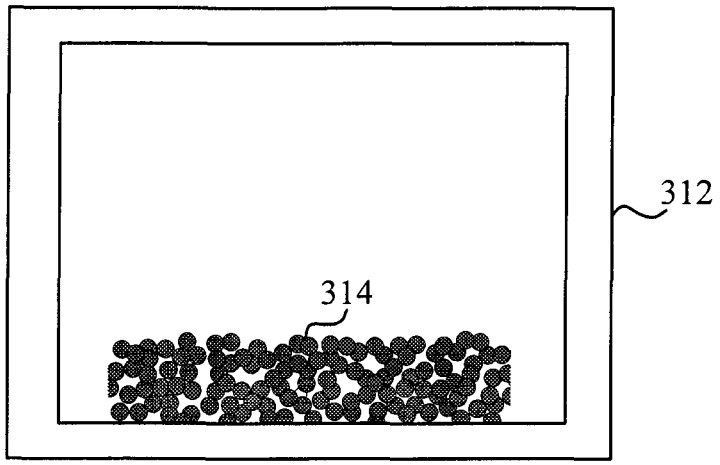

At FIG. 3B, preform composite 308 is removed from container 310 and placed in oven 312 for a drying and binder removal process. Heat from oven 312 removes binder 304 and water from preform composite 308 forming porous preform 314. In addition, the heat can fuse or sinter ceramic particles together such that voids form between the ceramic particle when the water and binder 304 are removed. In this way, porous preform 314 is formed, which includes voids where binder 304 and water once were. The void volume within porous preform 314 will depend in part on the relative amount of binder/water mixture 306 within preform composite 308, as well as the size of ceramic particles 302. In some embodiments, porous preform 314 undergoes one or more shaping processes, such as one or more machining or polishing processes.

Figure 3C:
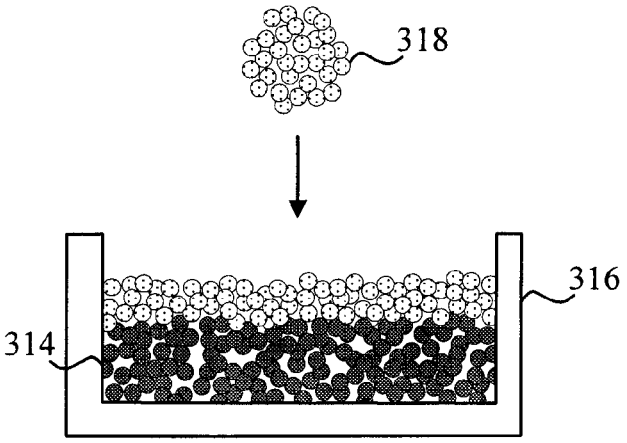
Figure 3D:
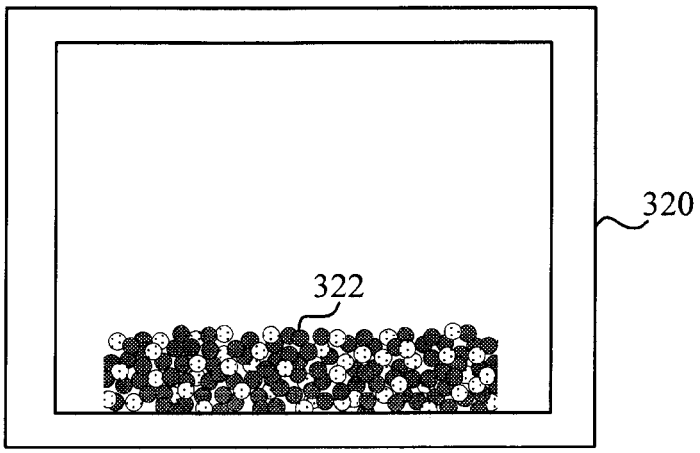

At FIG. 3C, porous preform 314 is placed within container 316 and gold particles 318 are added to porous preform 314. Gold particles 318 can be in any suitable form, including in a powder or flakes, and can be made of substantially pure gold or a gold alloy. In some embodiments, a wetting agent is added to porous preform 314 in order to assist binding of gold particles 318 to porous preform 314. At FIG. 3D, porous preform 314 and gold 318 are placed in oven 320. In some embodiments, container 316 is substantially non-chemically reactive to heat such that preform 314 and gold particles 318 remain within container 316 when placed in oven 320. Heat from oven 320 can melt gold particles 318 forming molten gold that infiltrates within the voids of porous preform 314 by capillary action. In some embodiments, gold particles 318 are heated to a temperature just over the melting point of gold particles 318. Pressure (such as by pressurized gas) can be applied within oven 320 while heating in order to assist the infiltration of molten gold within the voids of porous preform 314. The relative amount of gold particles 318 infiltrated within porous preform 314 will depend upon the void volume of porous preform and a desired karatage of the final gMMC. When the molten gold becomes sufficiently infiltrated within porous preform, gMMC 322 is formed.

Figure 3E:
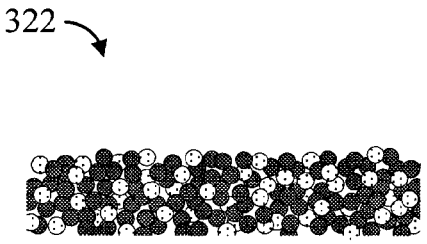

At FIG. 3E, gMMC 322 is removed from oven 320 and allowed to cool. As with gMMC 114 manufactured using powder metallurgy described above, gMMC 322 has higher scratch resistance and hardness compared to a gold or gold alloy structure and is generally requires less gold than a unit volume of a gold metal alloy. In some embodiments, gMMC 322 is shaped using, for example, one or more machining or polishing processes. In some embodiments, gMMC 322 is shaped into a housing or a portion of a housing for an electronic device.

Figure 4:
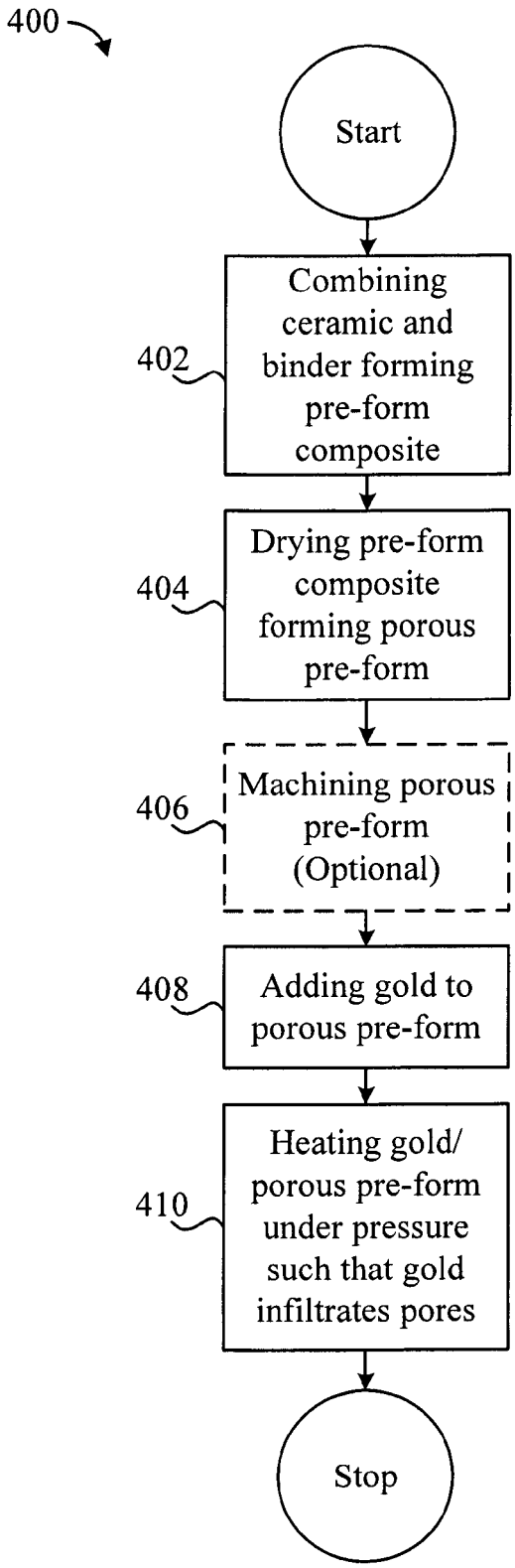
FIG. 4 shows a flowchart detailing the squeeze casting process in accordance with FIGS. 3A-3E.

FIG. 4 shows a flow chart detailing squeeze casting process 400 in accordance with the described embodiments. Process 400 can be carried out by performing at least the following operations. At 402, ceramic powder and binder (plus water) are combined forming a preform composite. At 404, the preform composite is dried and sintered, removing both the binder and water and forming a porous preform. At 406, an optional machining operation can be performed. In some embodiments, the optional machining operation can be used to shape the preform in accordance with a pre-determined final shape of the gMMC. At 408, gold is added to the porous preform. In some embodiments, the gold is in the form of gold particles (e.g., gold powder or flakes). At 410, the gold and ceramic preform is heated under pressure to a temperature just above a melting point of the gold. The heat liquefies the gold into molten gold, and the pressure facilitates the infiltration of the molten gold into the ceramic preform by way of capillary action. The result is a gMMC having a pre-determined shape. In some embodiments, the gMMC is further shaped forming a final shape.

FIGS. 5A-5D show a modified powder metallurgy process for forming a gMMC in accordance with described embodiments. At 5A, ceramic particles 502 are coated with gold forming gold-coated particles 504. In some embodiments, the coating is accomplished by heating gold or gold alloy material into molten form and blending in ceramic particles 502. In some embodiments, a wetting agent is added in order to assist binding of ceramic particles 502 and the molten gold. At 5B, gold-coated particles 504 are placed within die 508 having a near net shape that is similar to a final shape of the gMMC. Pressure 510 is exerted onto gold-coated particles 504 such that the density of gold-coated particles 504 is increased. After compression, compressed gold-coated particles 504 can be removed from die 508 and retain the near net shape.

Figure 5A:
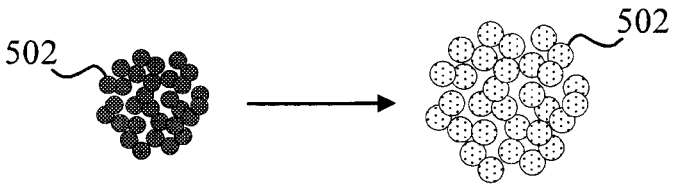
FIGS. 5A-5D show a modified powder metallurgy process for forming a gold metal matrix composite in accordance with described embodiments.
Figure 5B:
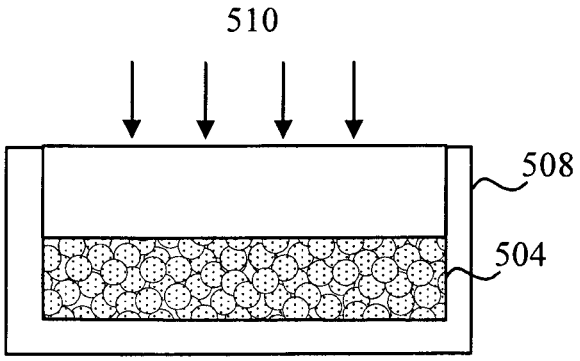
Figure 5C:
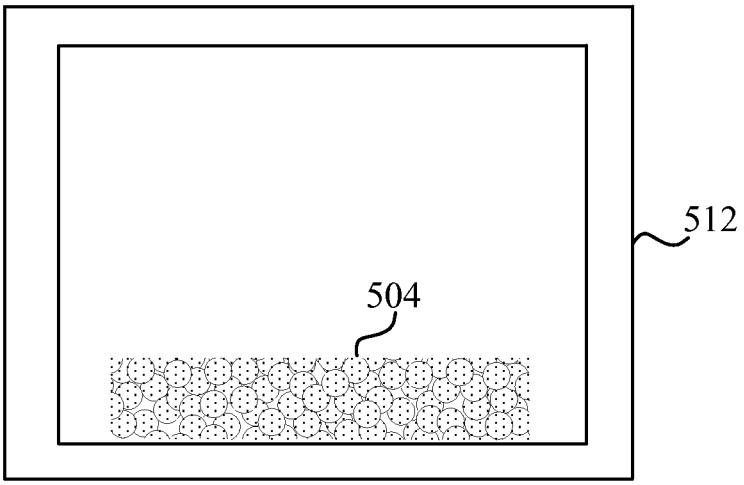
Figure 5D:
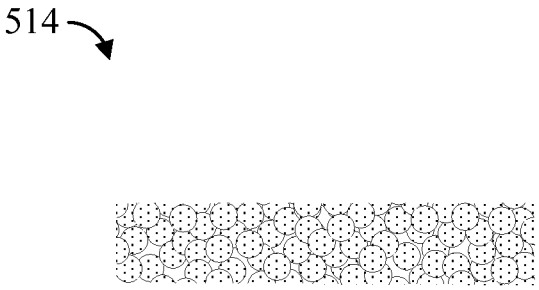

At FIG. 5C, compressed gold-coated particles 504 is placed into oven 512 and exposed to a sintering operation such that bonding occurs between gold-coated particles 504. In some embodiments, compressing process (FIG. 5B) and heating process (FIG. 5C) are combined within a single process, such as a HIP process. Once cooled, gMMC 514 is formed having the near net shape of die 508. At FIG. 5D, gMMC 114 is removed from oven 512. In some embodiments, gMMC 514 is then shaped using one or more shaping processes, such as one or more machining or polishing processes, such that gMMC 114 takes on a final desired shape. Since gMMC 514 includes a ceramic portion originating from ceramic particles 502, gMMC 514 has higher scratch resistance and hardness compared to a gold or gold alloy structure. As described above, the density of gMMC 514 of ceramic particles is less than metals generally used to alloy gold. Thus, a unit volume of gMMC 514 is generally less dense and thus requires less gold than a unit volume of a gold metal alloy. In some embodiments, gMMC 514 is shaped to form a housing or a portion of a housing for an electronic device.

Figure 6:
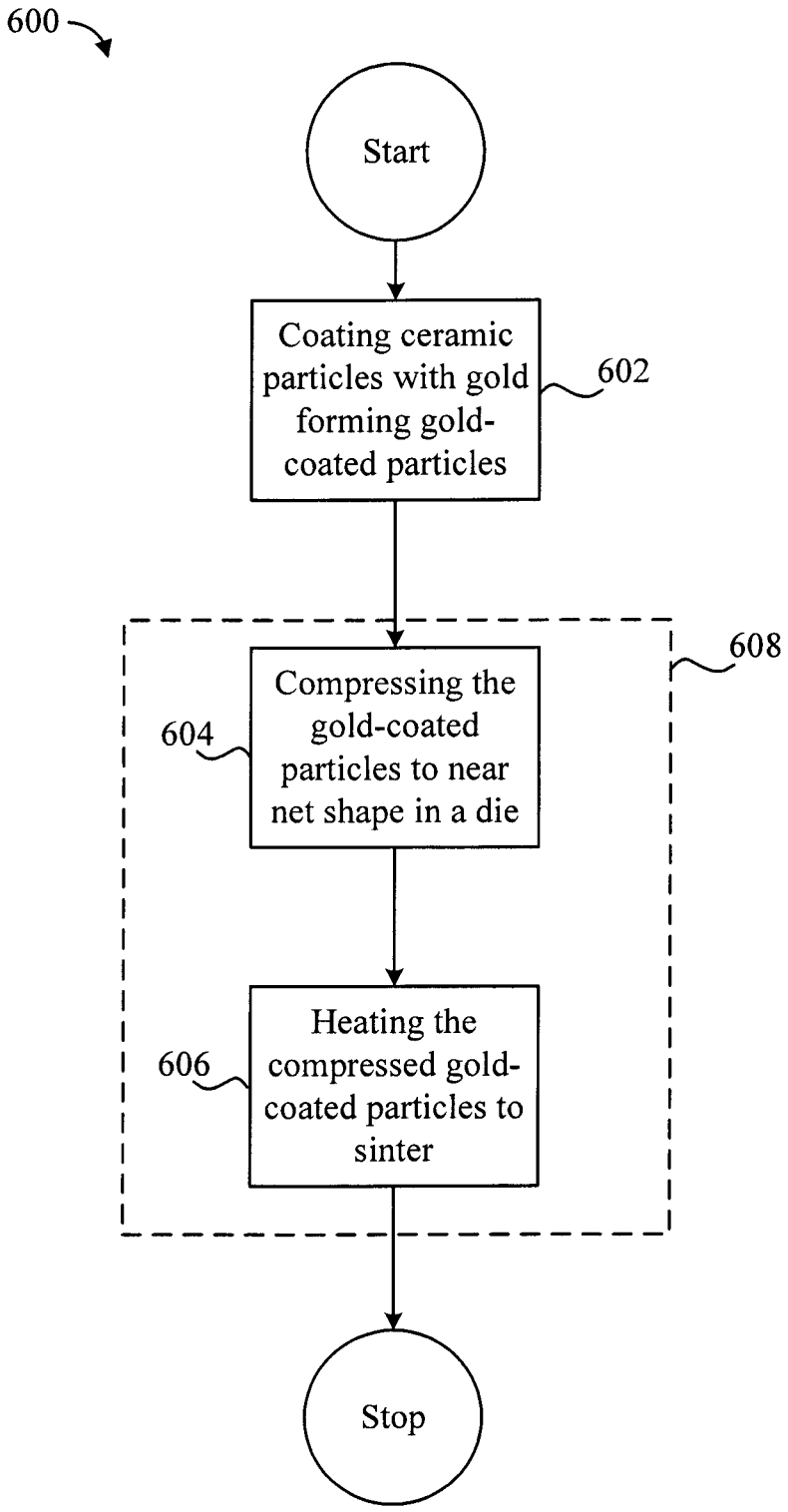
FIG. 6 shows a flowchart detailing the modified powder metallurgy process in accordance with FIGS. 5A-5D.

FIG. 6 is a flow chart detailing a modified powder metallurgy process 600 in accordance with the described embodiments. Process 600 can be carried out by performing at least the following operations. At 602, ceramic particles can be coated with gold forming gold-coated particles. The gold-coated particles can then be compressed at 604 in a manner that reduces spaces between and increasing the density of the gold-coated particles. At 606, the compressed gold-coated particles can undergo a heating operation having the effect of forming the gMMC. It should be noted that as with process 200 described above, operations 604 and 606 can be combined into a single operation 608 using HIP.

Table 1 below summarizes relative gold volume and mass of various 18 k gold samples A-F, in accordance with described embodiments.

TABLE 1

Relative Gold Volume and Mass of 18k Gold Samples

| Sample | Composition | Matrix Volume Fraction | Particle Volume Fraction | Part Mass | Mass of Gold in Part |
|---|---|---|---|---|---|
| A | 18k gold alloy (baseline) | 100% | 0% | 34.4 g | 25.8 g |
| B | Boron carbide/ pure gold MMC | 28% | 72% | 16.1 g (Δ 53%) | 12.1 g (Δ 43%) |
| C | Yellow diamond/ pure gold MMC | 34% | 66% | 19.1 g (Δ 44%) | 14.3 g (Δ 36%) |
| D | Cubic boron nitride/ pure gold MMC | 35% | 65% | 19.9 g (Δ 42%) | 14.9 g (Δ 34%) |
| E | Titanium nitride/ pure gold MMC | 46% | 54% | 26.1 g (Δ 24%) | 19.6 g (Δ 19%) |
| F | Red garnet/ pure gold cermet | 27% | 73% | 15.5 g (Δ 55%) | 11.6 g (Δ 55%) |

In Table 1, samples B-F are gMMC materials having different compositions. Sample A is an 18 k gold alloy sample, which is a gold metal alloy without any non-metal material (e.g., ceramic particles), and is used as a baseline for comparison with gMMC samples B-F. Samples A-F each have substantially the same volume. That is, they each represent a volume of a part. Matrix Volume Fraction refers to a volume percentage of non-particle material and Particle Volume Fraction refers to a volume percentage of particle material within the different 18 k gold samples. Part Mass refers to a mass of a part having a pre-defined volume and Mass of Gold in Part refers to the mass of gold within the part. Also included for gMMC samples B-F are the percentage change of the mass of the part and percentage change of the mass of gold in the part compared to gold alloy sample A.

Sample A (18 k gold alloy) is not a MMC material and, therefore, does not contain any MMC particle material. GMMC samples B-F are each gMMCs have different compositions. In particular, sample 2 is formed from boron carbide particles that are blended with pure gold, sample 3 is formed from yellow diamond particles that are blended with pure gold, sample 4 is formed from cubic boron nitride particles that are blended with pure gold, sample 5 is formed from titanium nitride particles that are blended with pure gold, and sample 6 is formed from red garnet particles that are blended with pure gold cermet. Pure gold cermet refers to a gold and ceramic material.

As described above, the choice of materials used in a gMMC can depend in part on the relative amount of gold used in the part. As indicated by Table 1, gMMC samples B-F each have less volume percentage of non-particle material and less gold mass than gold alloy sample A. Thus, a part manufactured using a composition of one or more of gMMC samples B-F can reduce the amount of gold within the part compared to a part made of gold alloy. The data of Table 1 can be used to choose the composition of a gMMC for manufacturing the part. For example, sample B (boron carbide/pure gold MMC) and sample F (red garnet/pure gold cermet) are characterized as having the lowest volume percentage of non-particle material, lowest part masses and lowest gold mass of the listed gMMC samples B-F. Thus, one may decide to use a gMMC having the composition corresponding to either sample B or sample F if such factors are desired. As described above, other factors, such as hardness, scratch resistance, machinability and color, can also be used to determine the composition of gMMC used in a manufactured part.

Table 2 below summarizes some cosmetic and physical properties of various 18 k gold samples 1-13, in accordance with described embodiments.

TABLE 2

Cosmetic and Physical Properties of 18 k Gold Samples

| Sample | Particle Type | Particle Color | Density | Melting Point | Pure Gold Matrix Volume Fraction | Ceramic Volume Fraction | MMC Density |
|---|---|---|---|---|---|---|---|
| 1 | 18 k gold alloy (baseline) | — | 19.3 g/cm$^3$ | 1060° C. | 75% | — | — |
| 2 | Iron aluminum silicate (garnet) | red, pink | 2.4 g/cm$^3$ | 1250° C. | 27% | 73% | 7.0 g/cm$^3$ |
| 3 | Boron carbide | brown/grey | 2.5 g/cm$^3$ | 2763° C. | 28% | 72% | 7.2 g/cm$^3$ |
| 4 | Silicon carbide | black, green | 3.2 g/cm$^3$ | 2730° C. | 33% | 67% | 8.6 g/cm$^3$ |
| 5 | Aluminum nitride | light grey | 3.3 g/cm$^3$ | 2200° C. | 34% | 66% | 8.7 g/cm$^3$ |
| 6 | Diamond powder | yellow, light grey | 3.3 g/cm$^3$ | 3550° C. | 34% | 66% | 8.6 g/cm$^3$ |
| 7 | Cubic boron nitride | amber | 3.5 g/cm$^3$ | 2967° C. | 35% | 65% | 9.0 g/cm$^3$ |
| 8 | Aluminum oxide | white/clear | 4.0 g/cm$^3$ | 2977° C. | 38% | 62% | 9.8 g/cm$^3$ |

TABLE 2-continued

Cosmetic and Physical Properties of 18 k Gold Samples

| Sample | Particle Type | Particle Color | Density | Melting Point | Pure Gold Matrix Volume Fraction | Ceramic Volume Fraction | MMC Density |
|---|---|---|---|---|---|---|---|
| 9 | Sapphire powder | clear or doped colors | 4.0 g/cm$^3$ | 2040° C. | 38% | 62% | 9.8 g/cm$^3$ |
| 10 | Yttrium oxide | white | 5.0 g/cm$^3$ | 2425° C. | 44% | 56% | 11.3 g/cm$^3$ |
| 11 | Titanium nitride | yellow | 5.4 g/cm$^3$ | 2930° C. | 46% | 54% | 11.8 g/cm$^3$ |
| 12 | Zirconia | white, black, colors | 5.9 g/cm$^3$ | 2715° C. | 48% | 52% | 12.3 g/cm$^3$ |
| 13 | Tungsten carbide | grey | 15.6 g/cm$^3$ | 2970° C. | 71% | 29% | 18.2 g/cm$^3$ |

In Table 2, sample 1 is an 18 k gold alloy sample and is used as a baseline for comparison with gMMC samples 2-13. Particle Type refers to the composition each sample, sample 1 being the only non-MMC sample. Particle Color refers to a perceived color of each of the samples. Density refers to the density of the particles in grams per cubic centimeter. Melting Point refers to the melting point of the sample. Pure Gold Matrix Volume Fraction refers to percentage volume of gold within the sample. Ceramic Volume Fraction refers to percentage volume of ceramic material within the sample. GMMC Density refers to the MMC density of each sample.

Table 2 provides information related to the appearance (color), amount of gold and physical properties (e.g., density, melting point) of gMMC samples 2-13, which can be used to design a composition of a manufactured part. For example, a gMMC formed from garnet particles (sample 2) can impart a red/pink color a final gold color of the gMMC. Similarly, a gMMC that includes aluminum oxide (sample 8) or titanium oxide (sample 10) can impart a white aspect to a final gold color of the gMMC. In addition, Table 2 indicates that gMMCs formed from garnet particles (sample 2) and boron carbide particles (sample 3) have the lowest density of the gMMC samples 2-13. Thus, gMMCs formed of these particles may be considered for manufacturing parts in which lighter weight is desirable. In some embodiments, two or more of particle types listed in Table 2 are used together in a single gMMC to give the gMMC a desired color.

Table 2 can provide information also provides information related to relative densities of gMMC materials using different ceramic materials. As shown, the gMMC densities using different ceramic particles can vary broadly. For example, an 18 k gMMC formed from garnet particles (sample 2) can have a density of 2.4 g/cm$^3$ while an 18 k gMMC formed from tungsten carbide particles (sample 13) can have a density of 15.6 g/cm$^3$. Thus, a part made of a gMMC material can be designed based in part on a desired final density. In some cases, it is desirable that the gMMC have a relatively low density in order to reduce a perceived heft of a part. According to some embodiments, an 18 k gold gMMC having a density of less than about 10 g/cm$^3$ is formed. According to some embodiments, an 18 k gold gMMC having a density of less than about 5 g/cm$^3$ is formed. According to some embodiments, an 18 k gold gMMC having a density ranging between about 2 g/cm$^3$ and about 5 g/cm$^3$ is formed.

Table 2 can also provide information as to other physical properties that can be helpful in deciding the type of ceramic particle to use, including melting point, volume fraction of ceramic particles and gold matrix density. According to some embodiments, an 18 k gold gMMC having a melting point of greater than about 1200° C. is formed. According to some embodiments, an 18 k gold gMMC having a volume fraction of ceramic particles is greater than about 50% is formed. According to some embodiments, an 18 k gold gMMC having a gold matrix with a density of 7.0 g/cm$^3$ or greater is formed.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A method of forming a gold metal matrix composite, comprising:

forming a gold and ceramic mixture by coating ceramic particles with gold, wherein relative amounts of the ceramic particles and the gold are chosen to result in the gold metal matrix composite as having 75% gold by mass with a ceramic fraction of at least 66%, wherein the ceramic particles include at least one of garnet, boron carbide, or aluminum nitride;

placing the gold and ceramic mixture into a die having a near net shape; and compressing and heating the gold and ceramic mixture in the die forming the gold metal matrix composite having a shape corresponding to the near net shape.

2. The method of claim 1, further comprising:

machining the gold metal matrix composite such that the gold metal matrix composite takes on a final shape.

3. The method of claim 1, wherein coating the ceramic particles comprises using a wetting agent to assist binding of the gold to the ceramic particles.

4. The method of claim 2, wherein the final shape corresponds to a shape of a housing or a portion of a housing for an electronic device.

5. The method of claim 1, wherein a density of the ceramic particles ranges from 2.4 g/cm$^3$ and 3.3 g/cm$^3$.

6. The method of claim 1, further comprising:

selecting an average size of the ceramic particles small enough to prevent removal of the ceramic particles during a subsequent polishing of the gold metal matrix composite.

7. The method of claim 1, wherein the ceramic particles are chosen based on a desired density of the gold metal matrix composite.

8. The method of claim 7, wherein the desired density of the gold metal matrix composite is 8.7 g/cm$^3$ or less.

9. The method of claim 1, wherein a desired density of the gold metal matrix composite ranges between about 7.0 g/cm$^3$ and about 9.0 g/cm$^3$.

10. The method of claim 1, wherein a melting point of the gold metal matrix composite is at least 1250 degrees Celsius.

11. The method of claim 1, wherein a volume fraction of the ceramic particles within the gold metal matrix composite is at least 72%.

12. The method of claim 1, wherein the gold metal matrix composite comprises an alloying metal.

13. A method of forming a gold metal matrix composite, comprising:

forming a gold and ceramic mixture by coating ceramic particles with gold, wherein relative amounts of the ceramic particles and the gold are chosen to result in the gold metal matrix composite as having an 18 k gold composition with a ceramic volume fraction of at least 65% wherein a density of ceramic particles is chosen to result in the gold metal matrix composite having a density of 8.7 g/cm$^3$ or less;

placing the gold and ceramic mixture into a die having a near net shape; and compressing and heating the gold and ceramic mixture in the die forming the gold metal matrix composite having a shape corresponding to the near net shape.

14. The method of claim 13, wherein the ceramic particles include at least one of garnet, boron carbide, or aluminum nitride.

15. The method of claim 13, further comprising: machining the gold metal matrix composite such that the gold metal matrix composite takes on a shape of a housing or a portion of a housing for an electronic device.

* * * * *